US008644543B2

(12) United States Patent
Lederer et al.

(10) Patent No.: US 8,644,543 B2
(45) Date of Patent: Feb. 4, 2014

(54) HEARING AID DEVICE HAVING A SEALING DEVICE

(71) Applicant: Siemens Medical Instruments Pte. Ltd., Singapore (SG)

(72) Inventors: Marco Lederer, Hirschaid/Erlach (DE); Andreas Ratay, Erlangen (DE); Hartmut Ritter, Neunkirchen am Brand (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/632,483

(22) Filed: Oct. 1, 2012

(65) Prior Publication Data

US 2013/0083952 A1 Apr. 4, 2013

(30) Foreign Application Priority Data

Sep. 29, 2011 (DE) ..... 10 2011 083 728

(51) Int. Cl.
*H04R 25/00* (2006.01)

(52) U.S. Cl.
USPC ..... 381/323; 381/322; 381/330

(58) Field of Classification Search
USPC ..... 381/314, 322, 323, 324, 328, 330, 189; 429/96, 97, 100
See application file for complete search history.

(56) References Cited

U.S. PATENT DOCUMENTS

| | | | | |
|---|---|---|---|---|
| 4,532,649 | A | 7/1985 | Bellafiore | |
| 4,961,230 | A | 10/1990 | Rising | |
| 5,187,746 | A * | 2/1993 | Narisawa | 381/323 |
| 6,041,128 | A * | 3/2000 | Narisawa et al. | 381/322 |
| 7,123,733 | B1 | 10/2006 | Borowsky et al. | |
| 8,103,032 | B2 | 1/2012 | Ho et al. | |
| 8,416,975 | B2 * | 4/2013 | Ho et al. | 381/330 |
| 2001/0008560 | A1 | 7/2001 | Stonikas et al. | |
| 2004/0057592 | A1 | 3/2004 | Niederdrank et al. | |
| 2008/0212817 | A1 | 9/2008 | Lommel et al. | |

FOREIGN PATENT DOCUMENTS

| | | | |
|---|---|---|---|
| DE | 44 44 586 | C1 | 2/1996 |
| DE | 199 03 090 | A1 | 8/2000 |
| DE | 10 2007 010 014 | A1 | 9/2008 |
| DE | 10 2007 047 335 | A1 | 4/2009 |
| DE | 10 2009 017 843 | A1 | 7/2010 |
| EP | 0341902 | A2 | 11/1989 |
| EP | 1377119 | A2 | 1/2004 |
| WO | 0025551 | A1 | 5/2000 |
| WO | 0045617 | A2 | 8/2000 |

* cited by examiner

*Primary Examiner* — Huyen D Le
(74) *Attorney, Agent, or Firm* — Laurence A. Greenberg; Werner H. Stemer; Ralph E. Locher

(57) ABSTRACT

With a hearing aid device in a frame configuration, acoustic feedback is avoided with an opened battery charger. To this end, a seal surrounds the frame component in an annular manner, the seal sealing a gap between the frame component and the housing thus providing a more user friendly hearing aid.

8 Claims, 1 Drawing Sheet

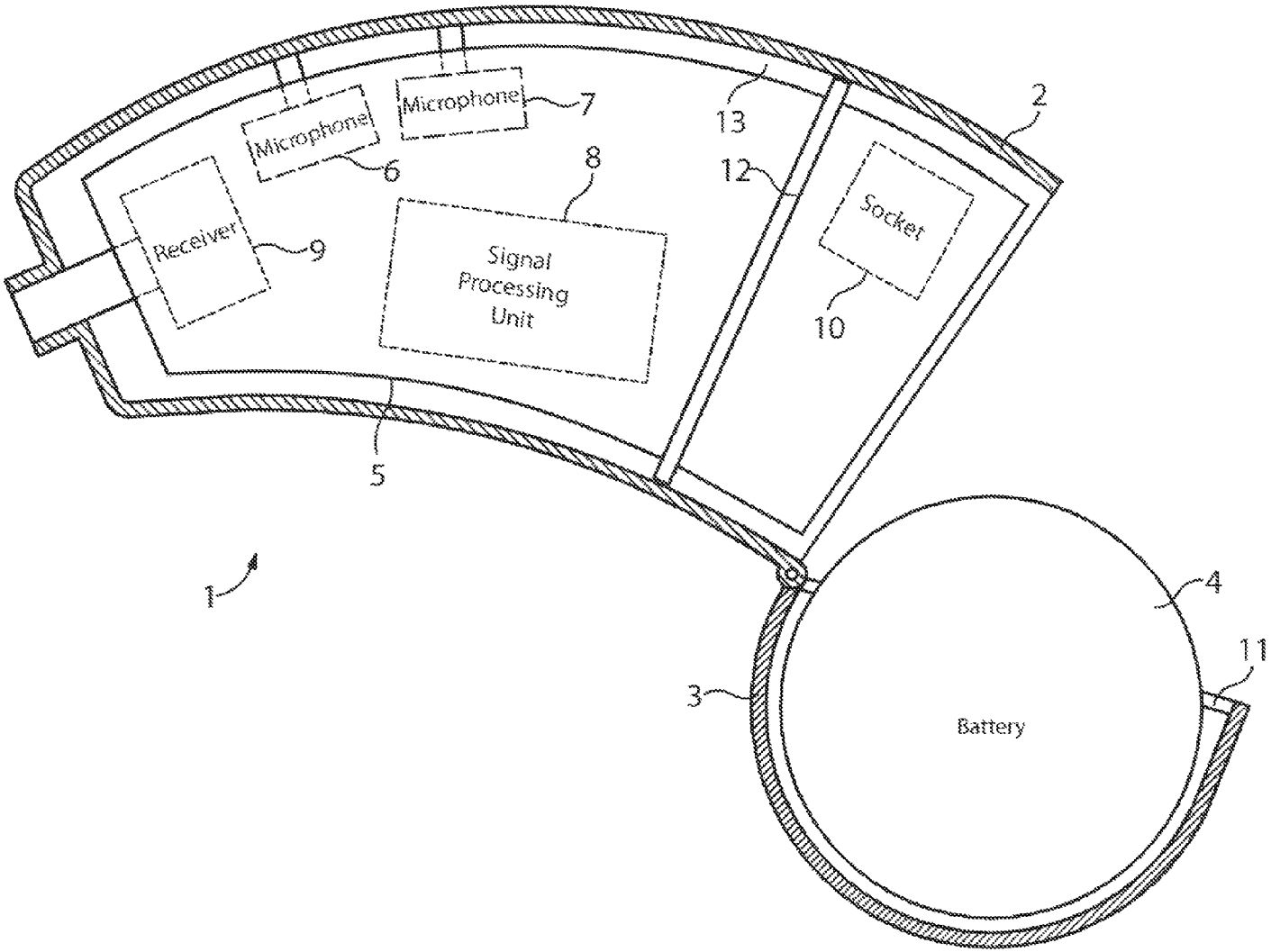
Socket
Battery
Microphone
Microphone
Signal Processing Unit
Receiver
1
2
3
4
5
6
7
8
9
10
11
12
13

HEARING AID DEVICE HAVING A SEALING DEVICE

CROSS-REFERENCE TO RELATED APPLICATION

This application claims the priority, under 35 U.S.C. §119, of German application DE 10 2011 083 728.0, filed Sep. 29, 2011; the prior application is herewith incorporated by reference in its entirety.

BACKGROUND OF THE INVENTION

Field of the Invention

The invention relates to a hearing aid device having at least one housing which surrounds a housing inner space, a microphone for recording an acoustic input signal and converting the signal into an electrical input signal, a signal processing unit for processing and frequency-dependent amplifying the electrical input signal and for generating an electrical output signal, a receiver for converting the electrical output signal into an acoustic output signal, a battery charger connected to the housing in a manner so as to be adjustable for opening and closing purposes, and a first sealing device, which prevents the penetration of moisture and/or water into the battery charger and housing when the battery charger is closed.

German patent DE 44 44 586 C1 discloses a programmable hearing aid having a hearing device housing with an electronic amplification facility in the signal path from a microphone to an receiver, a battery compartment cover to be opened and a battery compartment for receiving a battery for the electrical power supply and with an electrical programming connection, which is connected to the amplification facility in an electrically conductive manner. Wherein contacts of the amplification facility form the programming connection and a programming adapter can be contacted with the contacts of the programming connection through a gap formed between the opened battery compartment cover and the hearing device housing for signal transmission purposes.

Published, non-prosecuted German patent application DE 10 2007 010 014 A1, corresponding to U.S. patent publication No. 2008/0212817, discloses a hearing device in a frame design. A frame is provided in the process, to which the electrotechnical components of the hearing device are fastened. The frame can be connected to the housing components of the hearing device in a detachable manner.

Published, non-prosecuted German patent application DE 199 03 090 A1, corresponding to U.S. Pat. No. 7,123,733, discloses a water-tight hearing aid device having a housing, in which an O-ring seal prevents the penetration of water between a battery charger and the housing.

Published, non-prosecuted German patent application DE 10 2009 017 843 A1 discloses a housing with an exchangeable battery compartment for a hearing apparatus. The battery compartment can also be provided with a programming plug or an audio shoe.

Published, non-prosecuted German patent application DE 10 2007 047 335 A1, corresponding to U.S. Pat. No. 8,103,032, also discloses a hearing device having a three-part housing. An electrical energy source is provided in a first housing part and electronic components are provided in a second housing part. A third housing part is provided to convey audio stimuli into an ear of a user. The housing parts are connected to one another in a detachable and water-tight manner. A control element which is arranged in a leak-tight manner on the exterior is also provided on the first or second housing part.

Feedback presents a huge problem during operation of hearing aid devices. Feedback develops if sound generated by the receiver and fed to the ear of a user reaches the microphone of the hearing aid device. In this process it is irrelevant which path the sound takes between the receiver and the microphone. It may be that the sound reaches the microphone of the hearing aid device by way of acoustic leakages in the hearing aid device housing.

SUMMARY OF THE INVENTION

The object of the invention is to prevent acoustic feedback in hearing aid devices.

The object is achieved with a hearing aid device having at least one housing, which surrounds a housing inner space, a microphone for recording an acoustic input signal and converting the signal into an electrical input signal, and a signal processing unit for processing and frequency-dependent amplifying the electrical input signal and for generating an electrical output signal. The hearing aid further has a receiver for converting the electrical output signal into an acoustic output signal, a battery charger connected to the housing so as to be adjusted for the purposes of opening and closing and a first sealing device, which prevents the penetration of moisture and/or water into the battery charger and the housing when the battery charger is closed. A second sealing device exists which acoustically seals at least one part of the housing inner space from an outer space surrounding the hearing aid device.

The hearing aid device according to the invention includes at least one microphone for recording sound. Naturally a number of microphones for forming a directional microphone system can however also exist. Feedback in hearing aid devices then generally develops if the sound generated by the receiver reaches the microphone and/or microphones via the sound inlet opening and/or sound inlet openings in the housing of the hearing aid device. Upon the development of feedback, the signal portions which are transmitted through the hearing aid device housing to a microphone can however also frequently not be ignored. With a hearing aid device embodied in a water-tight manner, the sealing device arranged in the region of the battery charger which prevents the penetration of moisture and/or water into the hearing aid device, when the battery charger is closed, generally prevent the sound generated by the receiver from penetrating outwards through the battery charger and thus reaching a microphone via the outer space surrounding the hearing aid device.

Aside from the first sealing device which prevents the penetration of moisture and/or water into the hearing aid device when the battery charger is closed, the invention provides for a second sealing device, which acoustically seals at least one part of the housing inner space from the surroundings of the hearing aid device, the outer space. In particular, part of the housing inner space, in which the receiver is arranged, is acoustically sealed from the battery charger. When the battery charger is opened, no sound generated by the receiver can penetrate outwards through the housing, reach the microphone via this path and generate feedback.

The first and/or second sealing devices are preferably embodied in the form of one or a number of seals, in particular rubbery—elastic annular seals, which interact with correspondingly embodied sealing surfaces.

One embodiment of the invention provides that the first and second sealing devices include a shared seal, in particular a seal surrounding the housing in an annular fashion in the region of the battery charger, which offers both protection from the penetration of dirty or moisture when the battery charger is closed and also protection against acoustic feedback when the battery charger is opened.

The acoustic tightness of the hearing aid device relative to the outer space is then in particular not provided when the battery charger is opened, if a so-called frame concept is pursued in the hearing aid device. Here a frame component is present as a support for the electronic components of the hearing aid device, such as the microphone, the receiver or a printed circuit board, on which electronic components are arranged.

Provision is made in one embodiment of the invention for the frame component with the electrotechnical components fastened thereto to be insertable into the housing by way of the opened battery charger and to be connectable to the housing in a detachable manner. To ensure that the frame component can also always be inserted into the housing in the instance of component tolerances, a specific minimum distance is provided between the frame component inserted into the housing and the housing. This clearance nevertheless favors the appearance of feedback. According to the invention, the second sealing device with a seal surrounding the frame component and/or along the housing wall is provided, by which the gap between the frame component and the housing is sealed. This prevents sound escaping from the housing reaching the microphones through this gap and the opened battery charger.

With a hearing aid device in a frame design according to the invention, the first and second sealing devices advantageously include a shared seal, which is embodied and arranged such that even with an opened battery charger it completely seals the gap between a frame component and the housing around the frame component. Both the penetration of moisture and water into the hearing aid device when the battery charger is closed and thus also the development of feedback when the battery charger is opened is thus prevented with a single seal, and the corresponding sealing surfaces.

In an alternative embodiment of the invention the first and second sealing devices include two separate seals, wherein a first seal is attached to the battery charger and effects a seal of the closed battery charger and a second seal are arranged on the frame component, which prevents acoustic feedback. As a result, the first seal arranged on the battery charger, which is exposed to increased wear, can be replaced more easily.

A particular embodiment of the invention provides that a connection device for a wire connection with a programming device exist within the housing of the hearing aid device. The connection device is preferably a socket, by which a connection to the programming device can be established by a correspondingly molded plug by way of a cable. In this way the connection device arranged within the housing are advantageously accessible from outside of the housing by way of the opened battery charger. The connection device arranged within the housing is advantageous in that no space on the exterior of the housing of the hearing aid device is required herefor. This contributes to the miniaturization always aspired to in hearing aid devices.

The programming of a hearing aid device by way of a cable, which is inserted into the housing of the hearing aid device by way of the opened battery charger, is nevertheless disadvantageous in that the risk of feedback via the opened battery charger is significantly increased. According to the invention, the second sealing device for sealing the housing inner space of the hearing aid device from the outer space is arranged such that sound generated by the receiver can also not penetrate outwards through the opened battery charger, and/or is effectively dampened by the sealing device. As a result, the risk of feedback during the programming of the hearing aid device is significantly reduced by way of the opened battery charger.

Other features which are considered as characteristic for the invention are set forth in the appended claims.

Although the invention is illustrated and described herein as embodied in a hearing aid device having a sealing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The single FIGURE of the drawing is a diagrammatic, sectional view of a hearing aid device according to the invention.

DETAILED DESCRIPTION OF THE INVENTION

Referring now to the single FIGURE of the drawing in detail, there is shown a hearing aid device 1 which can be worn behind an ear and having a housing 2, which surrounds a housing inner space 13, and a battery charger 3 fastened to the housing 2 in an adjustable, in particular pivotable manner.

A voltage source 4, in particular a battery or a rechargeable battery, can be inserted into the battery charger 3 in a detachable manner. Electrotechnical components of the hearing aid device 1, such as the microphone 6 and 7, a printed circuit board 8 with non-illustrated electrotechnical components and a receiver 9 are arranged on a frame component 5, which acts as a support for the electrotechnical components. Furthermore, a socket 10 is disposed within the housing 2 and likewise fastened to the frame component 5, by way of which socket the hearing aid device 1 can be connected to a non-illustrated programming device by a suitable plug, to which a cable is fastened, when the battery charger 3 is opened. To prevent acoustic feedback particularly during the programming of the hearing aid device, in which the battery charger 3 is at least slightly opened, a seal 12 which is preferably fastened to the frame component 5 and surrounds the frame component 5 in an annular fashion exists, which seals the clearance between the frame component 5 and the housing 2. Furthermore, the frame component 5 is created such that no acoustic channel exists between the end of the frame component 5 oriented toward the battery charger 3 and the receiver 9 through the frame component 5. This prevents sound generated by the receiver 9, particularly when the battery charger 3 is opened, from reaching the microphones 6 and 7 through the clearance between the frame component 5 and the housing 2 via the opened battery charger 3 and the outer space surrounding the hearing aid device 1. Alternatively, the seal 12 can naturally also be fastened to the housing 2.\

The hearing aid device 1 according to the exemplary embodiment of the invention advantageously also includes a seal 11 surrounding the battery charger 3 in an annular manner, which prevents the penetration of dirt, moisture or water into the hearing aid device 1 when the battery charger 3 is closed.

The invention claimed is:

1. A hearing aid device, comprising:

at least one housing surrounding and defining a housing inner space;

a microphone disposed in said housing and recording an acoustic input signal and converting the acoustic input signal into an electrical input signal;

a signal processing unit for processing and frequency-dependent amplifying the electrical input signal and for generating an electrical output signal;

a receiver for converting the electrical output signal into an acoustic output signal;

a battery charger connected to said housing so as to be adjustable for opening or closing purposes;

a first sealing device for preventing a penetration of moisture and/or water into said battery charger and said housing when said battery charger is closed; and a second sealing device for acoustically sealing at least one part of said housing inner space from an outer space surrounding the hearing aid device when said battery charger is opened.

2. The hearing aid device according to claim 1, wherein part of said housing inner space, in which said receiver is disposed, is sealed off from the outer space.

3. The hearing aid device according to claim 1, further comprising a frame component, said microphone, said signal processing unit, and said receiver are fastened to said frame component.

4. The hearing aid device according to claim 3, wherein said second sealing device is connected to said frame component.

5. The hearing aid device according to claim 3, wherein said frame component can be inserted into said housing by way of an opened said battery charger.

6. The hearing aid device according to claim 3, wherein said first sealing device and said second sealing device are disposed on said battery charger and on said frame component in each instance.

7. The hearing aid device according to claim 1, further comprising an electrical connection device for a wire connection to a programming device disposed within said housing.

8. The hearing aid device according to claim 7, wherein said electrical connection device is accessible from outside by way of the opened said battery charger.

* * * * *